US005969299A

United States Patent [19]

Yamaguchi et al.

[11] Patent Number: 5,969,299

[45] Date of Patent: Oct. 19, 1999

[54] EXHAUST SYSTEM FOR VEHICLE

[75] Inventors: Hideki Yamaguchi; Osamu Bunya; Noriyuki Kawamata, all of Saitama, Japan

[73] Assignee: Honda Giken Kogyo Kabushiki Kaisha, Tokyo, Japan

[21] Appl. No.: 09/047,414

[22] Filed: Mar. 25, 1998

[30] Foreign Application Priority Data

Mar. 25, 1997 [JP] Japan ..... 9-071114

[51] Int. Cl.[6] ..... F01N 7/08

[52] U.S. Cl. ..... 181/227; 181/228; 181/231

[58] Field of Search ..... 181/227, 228, 181/231, 255, 258, 282; 55/DIG. 30

[56] References Cited

U.S. PATENT DOCUMENTS

| | | | |
|---|---|---|---|
| 3,757,892 | 9/1973 | Raudman, Jr. | 181/231 |
| 3,786,896 | 1/1974 | Foster et al. | 181/231 |
| 3,884,655 | 5/1975 | Coop | 181/231 |
| 4,318,720 | 3/1982 | Hoggatt | 181/228 |
| 5,627,351 | 5/1997 | Okuma et al. | 181/231 |

FOREIGN PATENT DOCUMENTS

| | | |
|---|---|---|
| 56/56915 | 5/1981 | Japan . |
| Y2 57/12176 | 3/1982 | Japan . |
| 62-35013 | 2/1987 | Japan . |
| 62-59194 | 3/1987 | Japan . |
| 5-27270 U | 4/1993 | Japan . |
| 5-246385 | 9/1993 | Japan . |
| 7-71279 | 3/1995 | Japan . |
| 7-97912 | 4/1995 | Japan . |
| 7-180556 | 7/1995 | Japan . |
| 8-61046 | 3/1996 | Japan . |

*Primary Examiner*—Khanh Dang

*Attorney, Agent, or Firm*—Birch, Stewart, Kolasch & Birch, LLP

[57] ABSTRACT

An exhaust system for a vehicle includes a muffler connected to an exhaust pipe, which is in turn connected to an engine. A spark arrester is provided with a tail pipe and connected to the rear end of the muffler, and is capable of discharging an exhaust gas flowing through the muffler through the tail pipe of the spark arrester into the atmosphere. The interior of the muffler can be divided into a plurality of expansion chambers connected by restricting passages by attaching the spark arrester to the muffler to enhance the sound attenuating effect. The interior of the muffler is divided into the plurality of expansion chambers by separators disposed in the muffler and a spark arrester combined with the muffler.

15 Claims, 8 Drawing Sheets

EXHAUST SYSTEM FOR VEHICLE

BACKGROUND OF THE INVENTION

1. Field of the Invention

The present invention relates to improvements in an exhaust system for a vehicle, and more particularly, to an exhaust system employing a spark arrester provided with a tail pipe and connected to the rear end of a muffler which is connected to an exhaust pipe in order to discharge exhaust gas from the muffler through the tail pipe of the spark arrester and into the atmosphere.

2. Description of the Background Art

A prior art exhaust system provided with a spark arrester for a motorcycle is disclosed in JP-A No. 8-61046. The exhaust system has a spark arrester incorporated into a muffler connected to an exhaust pipe, which is in turn connected to the exhaust port of an engine. A filter is included in the spark arrester which is inserted into an expansion chamber formed in the muffler to attenuate noise generated by the exhaust gas flowing through the muffler, and to arrest unburned components including soot or the like so that the unburned components may not be emitted into the atmosphere.

Usually this prior art exhaust system employs technical means for enhancing the suppression of exhaust noise, which divides the silencing chamber of the muffler into a plurality of expansion chambers, and connects the expansion chambers by restricting passages to deaden the exhaust noise by repeatedly expanding and compressing the exhaust gas while the exhaust gas is flowing through the expansion chambers and the restricting passages. However, additional parts including connecting pipes are necessary to divide the silencing chamber of the muffler into a plurality of expansion chambers and to connect the plurality of expansion chambers by restricting passages. Consequently, the division of the silencing chamber into the plurality of expansion chambers needs an increased number of parts, makes the construction of the exhaust system complicated and increases the cost of the exhaust system.

SUMMARY OF THE INVENTION

It is therefore an object of the present invention to provide an exhaust system having a simple construction which is capable of exercising excellent noise deadening effect. The exhaust system includes a muffler having a silencing chamber divided into a plurality of expansion chambers connected sequentially by restricting passages, and a spark arrester combined with the muffler.

The exhaust system comprises an exhaust pipe, a muffler connected to the exhaust pipe, and a spark arrester provided with a tail pipe and connected to a rear end of the muffler to discharge exhaust gas flowing through the muffler through the tail pipe of the spark arrester into the atmosphere. In this exhaust system, the interior of the muffler is divided into a plurality of expansion chambers sequentially connected by restricting passages by separators disposed in the muffler, and the spark arrester. Thus, the silencing chamber of the muffler is divided into the plurality of expansion chambers by combining the spark arrester with the muffler. The expansion chambers are connected by the restricting passages, and the exhaust gas flowing from the exhaust pipe into the muffler is expanded and compressed repeatedly while the same is flowing sequentially through the expansion chambers and the restricting passages for effective noise attenuation. Also, unburned components including soot can be arrested by the spark arrester.

In the exhaust system of the present invention, the spark arrester is detachably attached to the muffler. Thus, the maintenance of the spark arrester can be facilitated. Further, an exhaust system having desired characteristics can be provided at a low cost by combining an appropriate spark arrester with the muffler.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Preferred embodiments of the present invention will be described with reference to the accompanying drawings, in which the terms front, rear, right, left, up and down refer to locations, sides or directions with respect to the traveling direction of a motorcycle.

An exhaust system according to a first embodiment of the present invention will be described with reference to FIGS. 1 to 6 as applied to a motorcycle.

Figure 1:
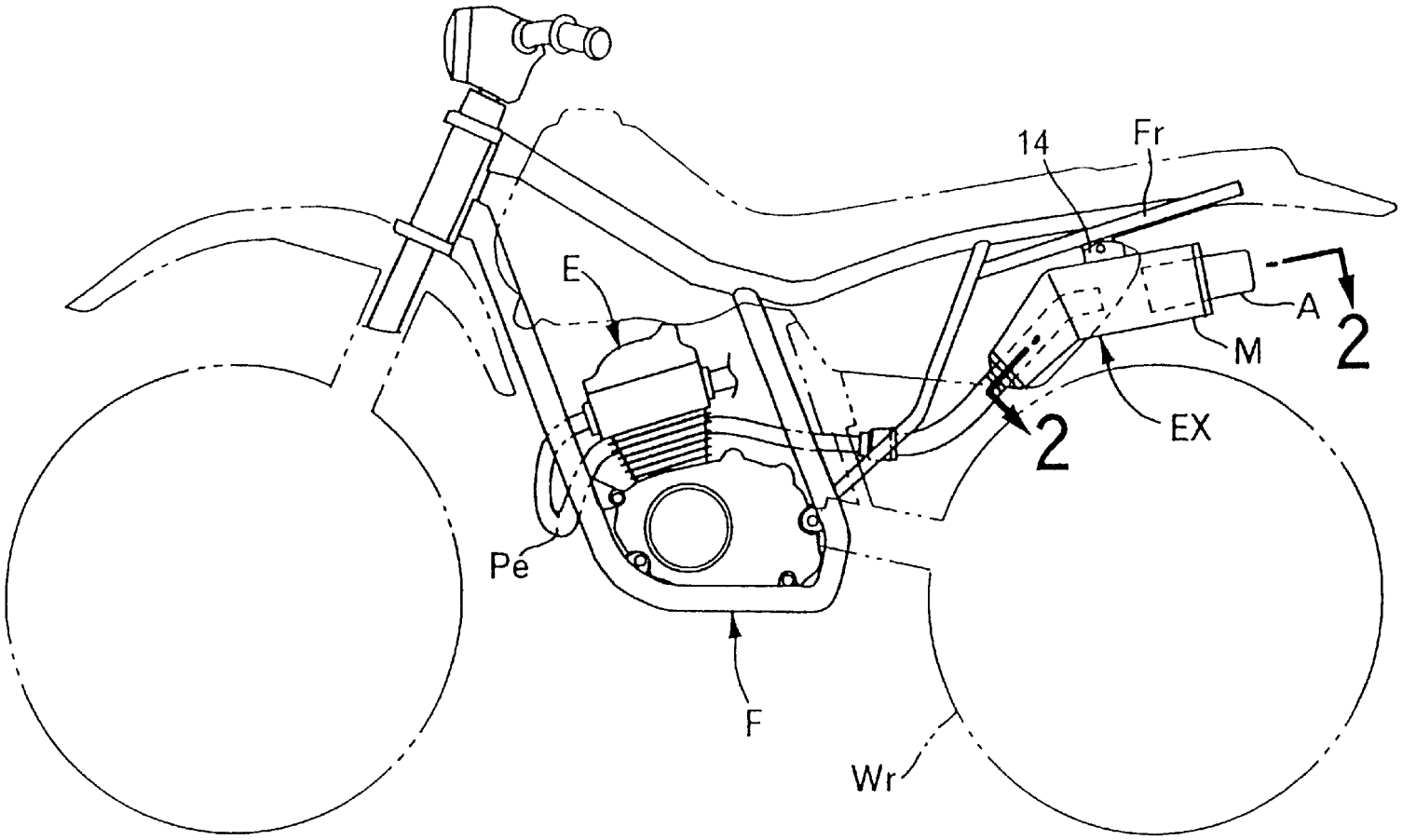
FIG. 1 is a side view of a motorcycle provided with the exhaust system of the present invention.
Figure 2:
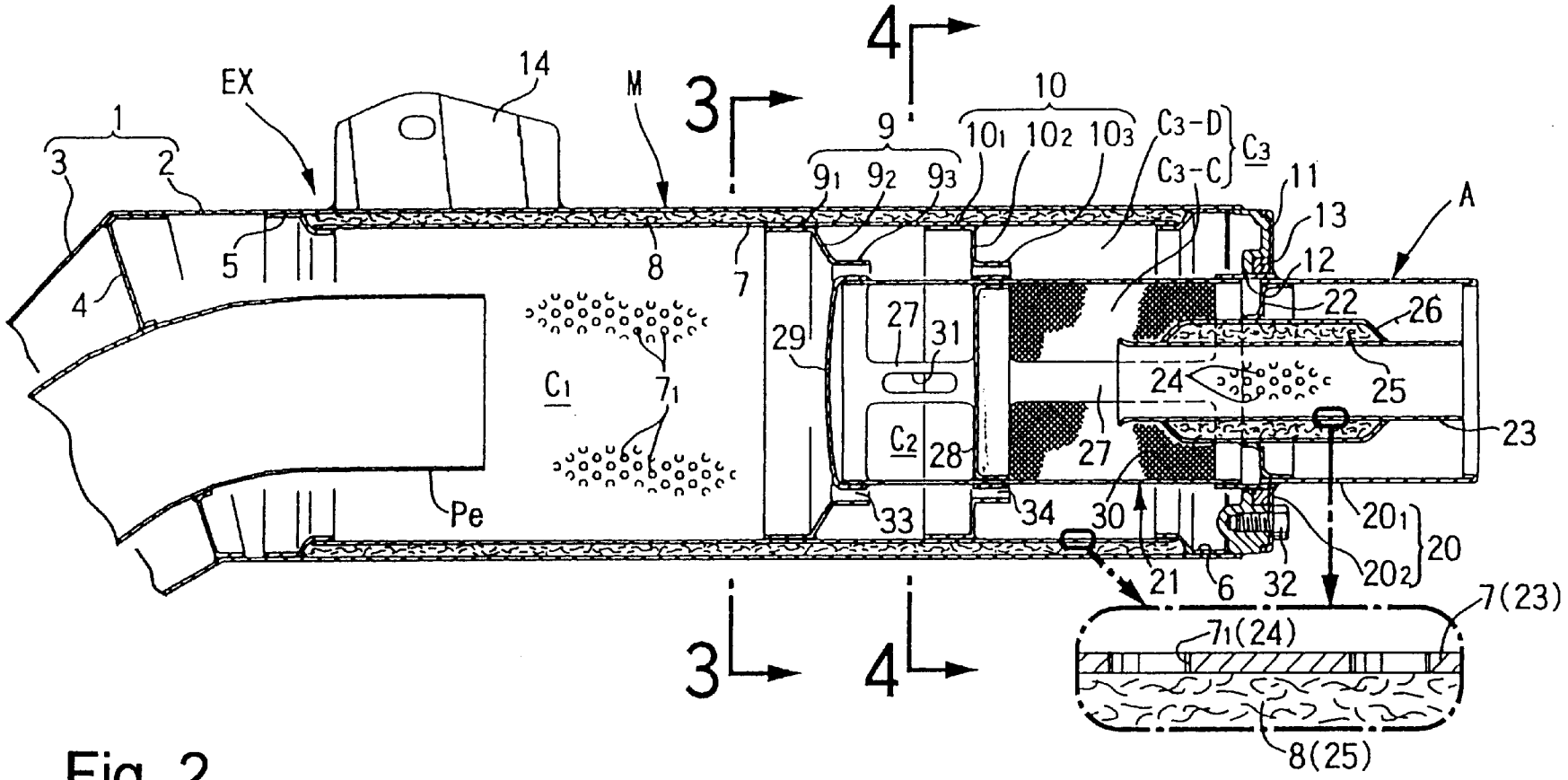
FIG. 2 is an enlarged, fragmentary, longitudinal sectional view taken on line 2—2 in FIG. 1.
Figure 3:
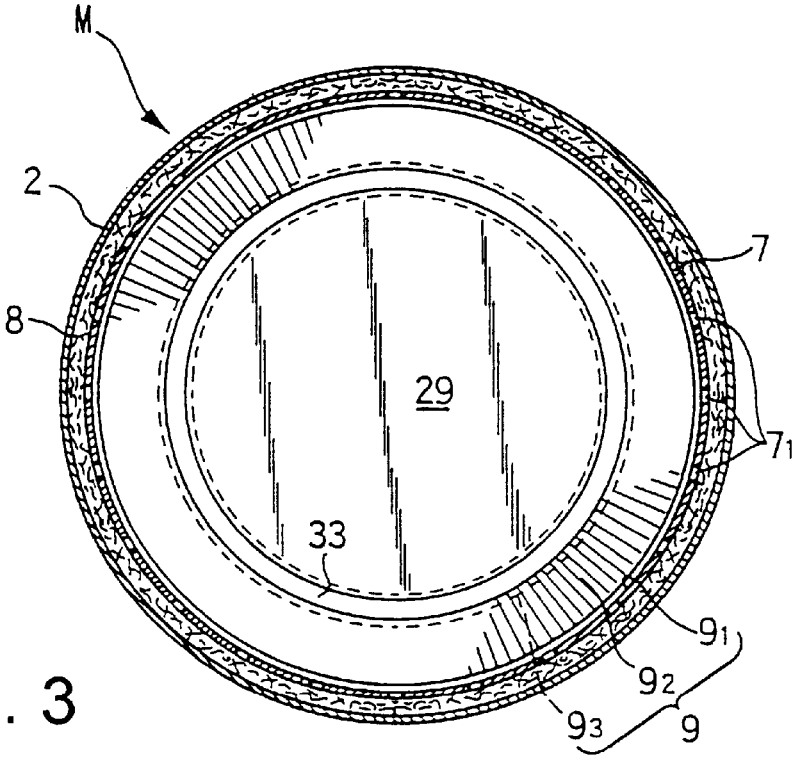
FIG. 3 is an enlarged sectional view taken on line 3—3 in FIG. 2.
Figure 4:
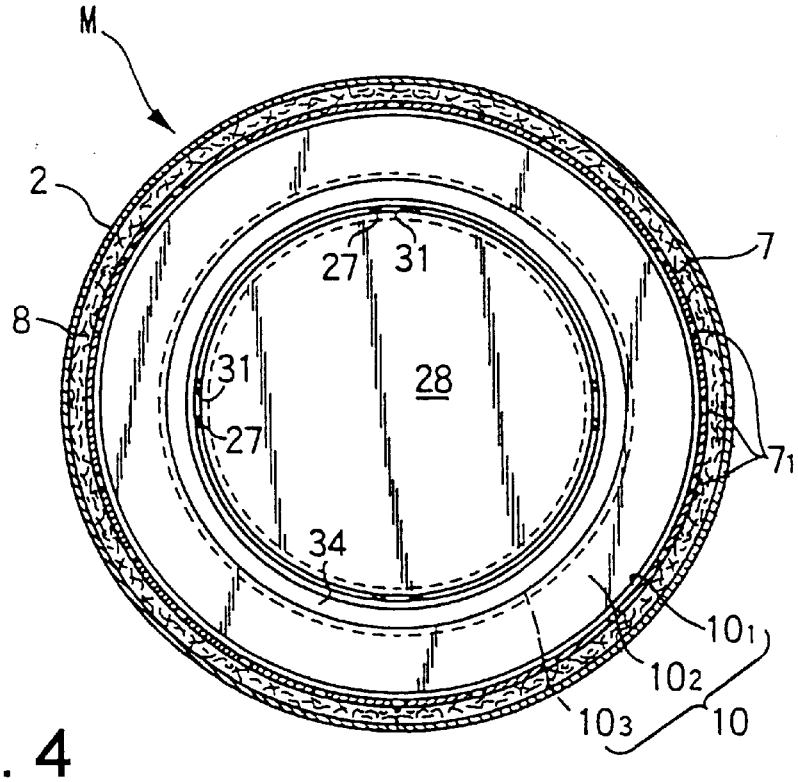
FIG. 4 is an enlarged sectional view taken on line 4—4 in FIG. 2.

Referring to FIG. 1, a motorcycle has a body frame F supporting an engine E. An exhaust port is formed in the front wall of the head of the engine E, and an exhaust pipe Pe is connected to the exhaust port. If the engine E is a multiple-cylinder engine, the exhaust pipe Pe is connected to an exhaust manifold connected to the exhaust ports of the cylinders of the engine E.

The exhaust pipe Pe extends around the front of the engine E, along one side of the engine E toward the rear of the body frame F. The rear end of the exhaust pipe Pe is connected to an exhaust system EX of the present invention at a position above a rear wheel Wr. The exhaust system EX is suspended from a rear frame Fr included in the body frame F.

The construction of the exhaust system EX will be described hereinafter mainly with reference to FIGS. 2 to 6. The exhaust system EX comprises a muffler M, and a spark arrester A detachably combined with the muffler M.

A muffler body 1, i.e., a principal component of the muffler M, includes a muffler pipe 2 having the shape of a hollow cylinder having opposite open ends, and a joint pipe 3 to be joined to the exhaust pipe Pe, having the shape of a truncated circular cone and extending obliquely downward toward the front. A curved rear end portion of the exhaust pipe Pe is inserted in the joint pipe 3, penetrates a central portion of an annular support wall 4 fixedly attached to the boundary between the muffler pipe 2 and the joint pipe 3 into the muffler pipe 2, is supported on the support wall 4, and opens into the muffler pipe 2. A front support ring 5 and a rear support ring 6 are welded to the inner circumference of a front portion and the inner circumference of a rear portion, respectively, of the muffler pipe 2. The opposite ends of an inner wall 7 formed by processing a perforated sheet provided with many punched holes $\mathbf{7}_1$ are welded to the support rings 5 and 6, respectively. A sound absorbing material, such as glass wool, is packed in an annular space defined by the muffler pipe 2 and the inner wall 7 to absorb exhaust noise generated by an exhaust gas which flows through the muffler pipe 2.

An annular first separator 9 and an annular second separator 10 are disposed at a longitudinal interval in a rear half section of the muffler pipe 2. The first and second separators 9 and 10 are welded to the inner circumference of the inner wall 7. The first separator 9 has an expanded section $\mathbf{9}_1$ welded to the inner wall 7, a tapered section $\mathbf{9}_2$ tapered toward the rear and extending from the expanded section $\mathbf{9}_1$, and a reduced section $\mathbf{9}_3$ extending toward the rear from the tapered section $\mathbf{9}_2$ The second separator 10 has an expanded section $\mathbf{10}_1$ welded to the inner wall 7, a flange $\mathbf{10}_2$ extending radially inward from the expanded section $\mathbf{10}_1$, and a reduced section $\mathbf{10}_3$ extending toward the rear from the flange $\mathbf{10}_2$. The first separator 9, the second separator 10 and a spark arrester A, which will be described later, divide the interior of the muffler pipe 2 into a first expansion chamber $C_1$, a second expansion chamber $C_2$ and a third expansion chamber $C_3$ arranged in that order from the upstream side toward the downstream side.

An annular end plate 11 provided with a central opening 12 in its central portion is welded to the rear open end of the muffler pipe 2. A recess for receiving an annular gasket 13 is formed in the inner circumference of the end plate 11 defining the central opening 12. A plurality of threaded holes $\mathbf{11}_1$ are formed in a peripheral portion of the end plate 11 at angular intervals.

A bracket 14 is welded to the upper surface of a front portion of the muffler pipe 2. The bracket 14 is fastened to the rear frame Fr to suspend the exhaust system EX comprising the muffler pipe 2 and the spark arrester A from the rear frame Fr (FIG. 1).

The construction of the spark arrester A will be described hereinafter. The spark arrester A comprises a holder 20 to be detachably attached to the muffler M, and a spark arrester body 21 welded to the holder 20. The holder 20 is formed by welding a flange $\mathbf{20}_2$ to a front end portion of the outer circumference of a hollow, cylindrical support tube $\mathbf{20}_1$. An annular support ring 22 is welded to a front end portion of the inner circumference of the support tube $\mathbf{20}_1$. A tail pipe 23 is inserted in the holder 20 coaxially with the holder 20. The tail pipe 23 has a front end opening into a central region of the interior of the spark arrester body 21 and a rear end opening into the atmosphere. A sound absorbing pipe 26 is put on and welded to the tail pipe 23 so as to surround a perforated middle portion of the tail pipe 23 having many small holes 24 therein, and is welded to the support ring 22. An annular space defined by the perforated middle portion of the tail pipe 23 and the sound absorbing pipe 26 is packed with a sound absorbing material 25, such as glass wool.

The spark arrester body 21 is held in a cantilever fashion on a front portion of the holder 20. The spark arrester body 21 has a plurality of ribs 27, i.e., strips, for defining the shape thereof. The base ends of the ribs 27 are arranged substantially at equal angular intervals on and welded to the front portion of the holder 20. A dishlike middle cap 28 is fixed to longitudinal middle portions of the ribs 27, and a dishlike end cap 29 is welded to the front ends of the ribs 27. A hollow, cylindrical filter element 30 formed by rounding a mesh sheet, such as a wire cloth, is attached to the inner surfaces of portions of the ribs 27 between the holder 20 and the middle cap 28. Portions of the ribs 27 between the middle cap 28 and the end cap 29 are provided with openings 31.

Figure 5:
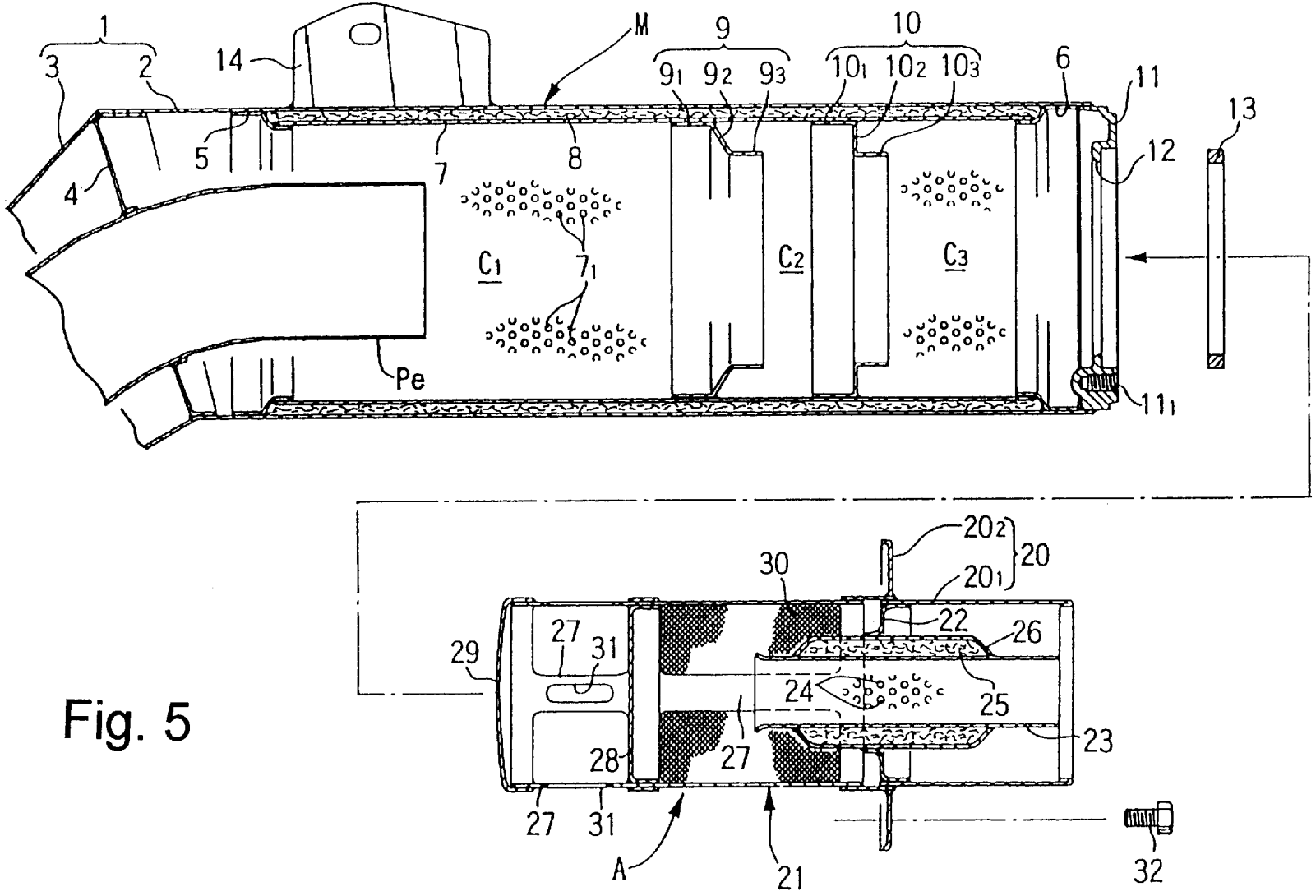
FIG. 5 is a longitudinal sectional view of a muffler and a spark arrester included in the exhaust system in the first embodiment, in which the muffler and the spark arrester are separated.
Figure 6:
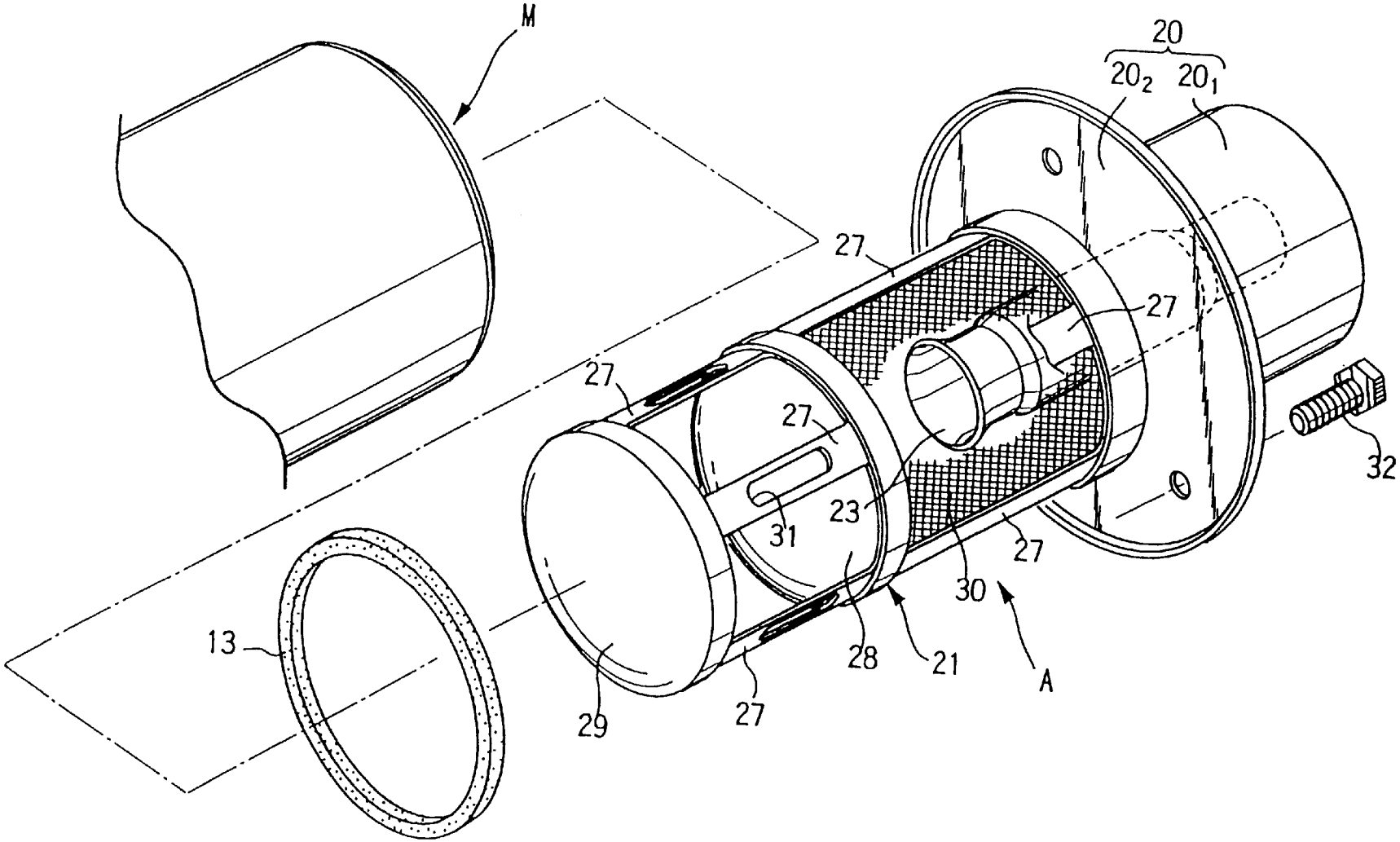
FIG. 6 is an exploded perspective view of a portion of the exhaust system in the first embodiment.

A procedure for detachably attaching the spark arrester A to the muffler M will be described hereinafter. As shown in FIG. 5, the spark arrester A is placed behind the muffler M with the end cap 29 thereof on the front side. The spark arrester body 21 is inserted in the rear half portion of the muffler M coaxially with the muffler M so that the front portion of the holder 20 is closely fitted in the central opening 12 of the end plate 11 of the muffler M. The flange $\mathbf{20}_2$ is fastened to the end plate 11 with a plurality of bolts 32. Thus, the spark arrester A is detachably attached to the rear half portion of the muffler M. In this state, the open rear end of the muffler M is closed by the flange $\mathbf{20}_2$, the gasket 13 seals the joint of the end plate 11 and the support tube $\mathbf{20}_1$ of the holder 20. The support tube $\mathbf{20}_1$ projects rearward from the rear end of the muffler M.

The spark arrester body 21 is held in the rear half portion of the muffler M coaxially with the latter. An annular first restricting passage 33 is formed between the outer circumference of the end cap 29 and the inner circumference of the reduced section $\mathbf{9}_3$ of the first separator 9. An annular second restricting passage 34 is formed between the outer circumference of the middle cap 28 of the spark arrester body 21 and the inner circumference of the reduced section $\mathbf{10}_3$ of the second separator 10.

The first expansion chamber $C_1$ and the second expansion chamber $C_2$ of the muffler M communicate with each other by means of the first restricting passage 33. The second expansion chamber $C_2$ and the third expansion chamber $C_3$ communicate with each other by means of the second restricting passage 34. The third expansion chamber $C_3$ is divided into an unclean gas chamber $C_3$-D and a clean gas chamber $C_3$-C by the filter element 30. The front end of the tail pipe 23 opens into the clean gas chamber $C_3$-C.

The operation of the first embodiment will be described hereinafter.

While the engine E (FIG. 1) is in operation, the exhaust gas discharged from the engine E flows through the exhaust pipe Pe into the muffler pipe 2 of the muffler M. In the muffler pipe 2, the exhaust gas is expanded and compressed repeatedly while the exhaust gas flows sequentially through the first expansion chamber $C_1$, the first restricting passage 33, the second expansion chamber $C_2$, the second restricting passage 34 and the third expansion chamber $C_3$, so that exhaust noise generated by the exhaust gas is attenuated effectively. While the exhaust gas is flowing from the unclean chamber $C_3$-D through the filter element 30 into the clean chamber $C_3$-C in the third expansion chamber $C_3$, unburned components including soot contained in the exhaust gas is arrested by the filter element 30. Thus, the exhaust gas is purified and the exhaust noise of the exhaust gas is attenuated. The exhaust gas is discharged through the tail pipe 23 into the atmosphere.

A second embodiment of the present invention will be described hereinafter, with reference to FIGS. 7 to 10. In FIGS. 7 to 10, parts like or corresponding to those of the first embodiment are designated by the same reference characters.

A muffler M included in the second embodiment will be described. A first separator 109 and a second separator 110 dividing the interior of a muffler pipe 2 into a first expansion chamber $C_1$, a second expansion chamber $C_2$ and a third expansion chamber $C_3$ are different in conformation from those of the first embodiment. The separator 109 has an expanded section $\mathbf{109}_1$ welded to the inner circumference of the muffler pipe 2, a radial wall $\mathbf{109}_2$ extending radially inward from the front end of the expanded section $\mathbf{109}_1$, and a reduced section $\mathbf{109}_3$ projecting forward from the inner circumference of the radial wall $\mathbf{109}_2$. The radial wall $\mathbf{109}_2$ is provided with a plurality of first restricting passages 133 having the shape of a circular slot and arranged at angular intervals. The first expansion chamber $C_1$ and the second expansion chamber $C_2$ communicate with each other by means of the first restricting passages 133.

The second separator 110 is the same in shape as the first separator 109. The second separator 110 has an expanded section $\mathbf{110}_1$ fixed to the inner circumference of the muffler pipe 2, a radial wall $\mathbf{110}_2$ extending radially inward from the front end of the expanded section $\mathbf{110}_1$, and a reduced section $\mathbf{110}_3$ projecting forward from the inner circumference of the radial wall $\mathbf{110}_2$. The radial wall $\mathbf{110}_2$ is provided with a plurality of second restricting passages 134 having the shape of a circular slot and arranged at angular intervals. The second expansion chamber $C_2$ and the third expansion chamber $C_3$ communicate with each other by means of the second restricting passages 134.

The spark arrester A has a front portion differing in construction from that of the spark arrester A of the first embodiment. A plurality of ribs 127 are arranged at substantially equal angular intervals and the rear ends of the ribs 127 are welded to a front end portion of a holder 20. A dishlike middle cap 128 is welded to the front ends of the ribs 127. A support rod 135 has a rear end welded to a central portion of the middle cap 128 and a front end welded to a central portion of an end cap 129. The support rod 135 extends axially forward from the spark arrester A.

The middle cap 128 is closely fitted in the reduced section 1103 of the second separator 110. The first separator 109, the end cap 129, the second separator 110 and the middle cap 128 divide the interior of the muffler pipe 2 into the first expansion chamber $C_1$, the second expansion chamber $C_2$ and the third expansion chamber $C_3$. The first expansion chamber $C_1$ and the second expansion chamber $C_2$ communicate with each other by means of the first restricting passages 133, and the second expansion chamber $C_2$ and the third expansion chamber $C_3$ communicate with each other by means of the second restricting passages 134.

Figure 7:
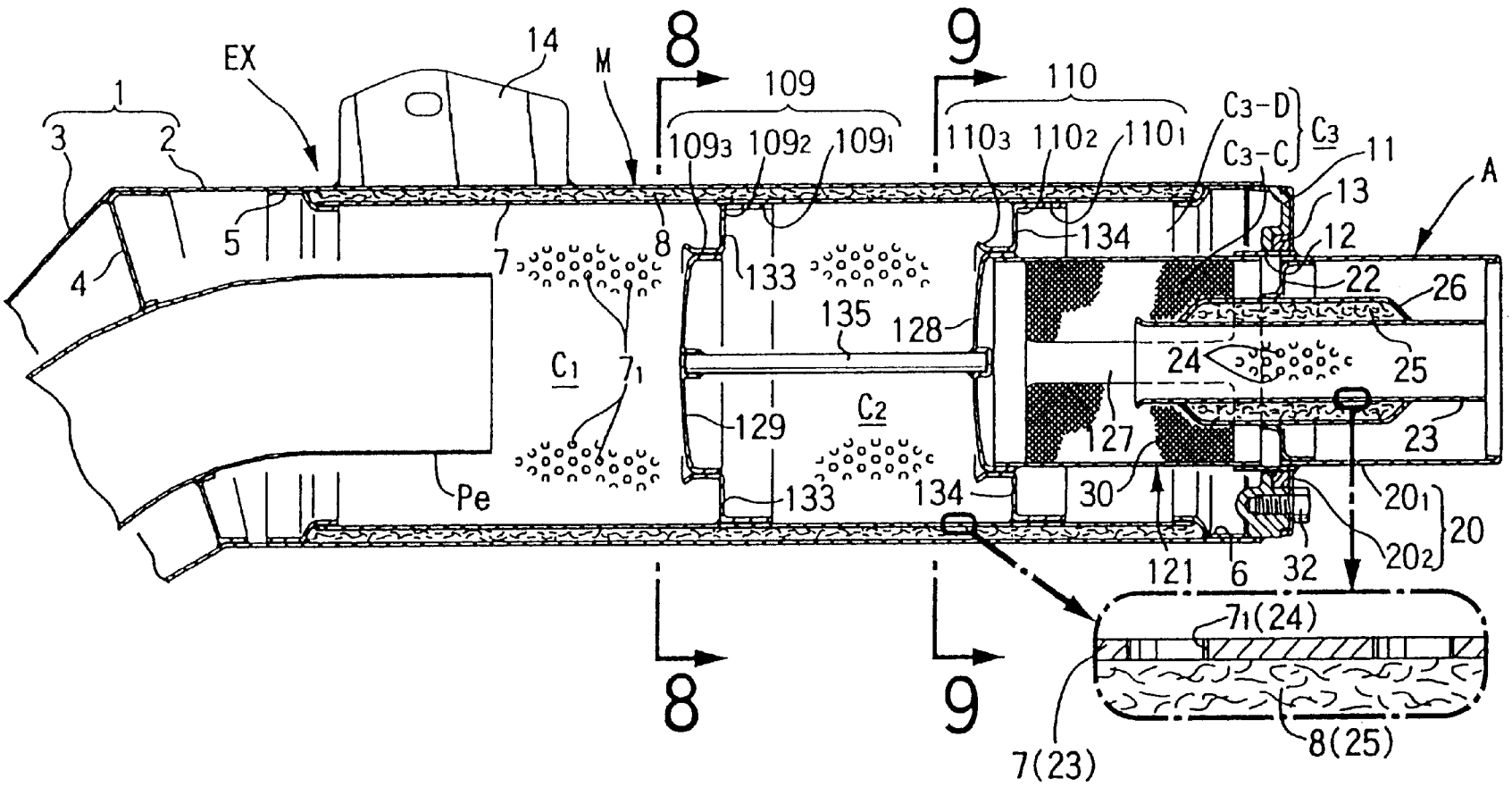
FIG. 7 is a longitudinal sectional view of a second embodiment of the exhaust system.
Figure 8:
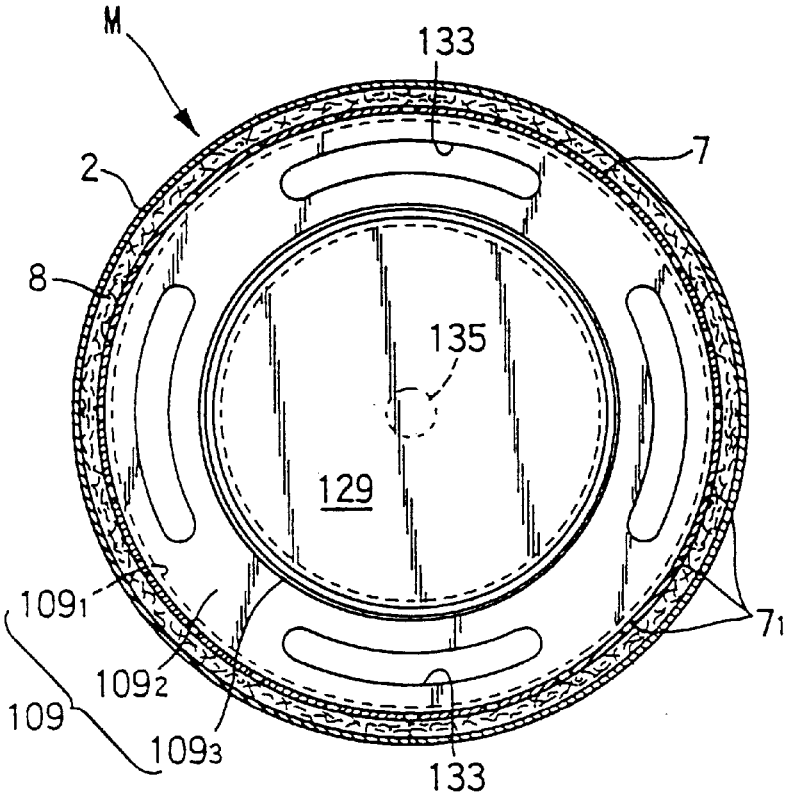
FIG. 8 is an enlarged sectional view taken on line 8—8 in FIG. 7.
Figure 9:
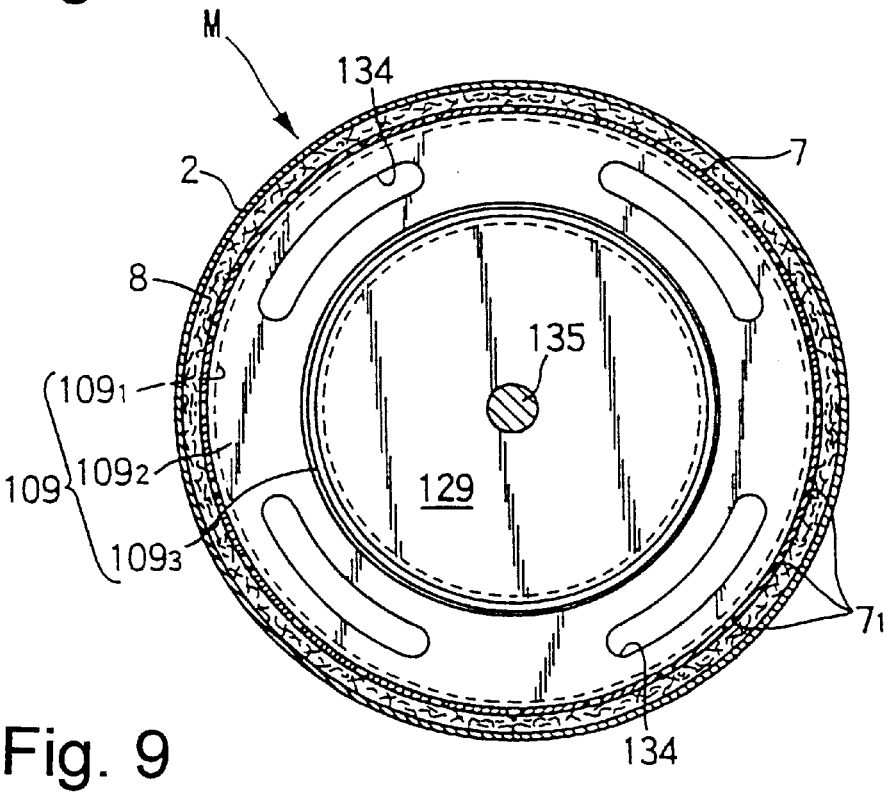
FIG. 9 is an enlarged sectional view taken on line 9—9 in FIG. 7.
Figure 10:
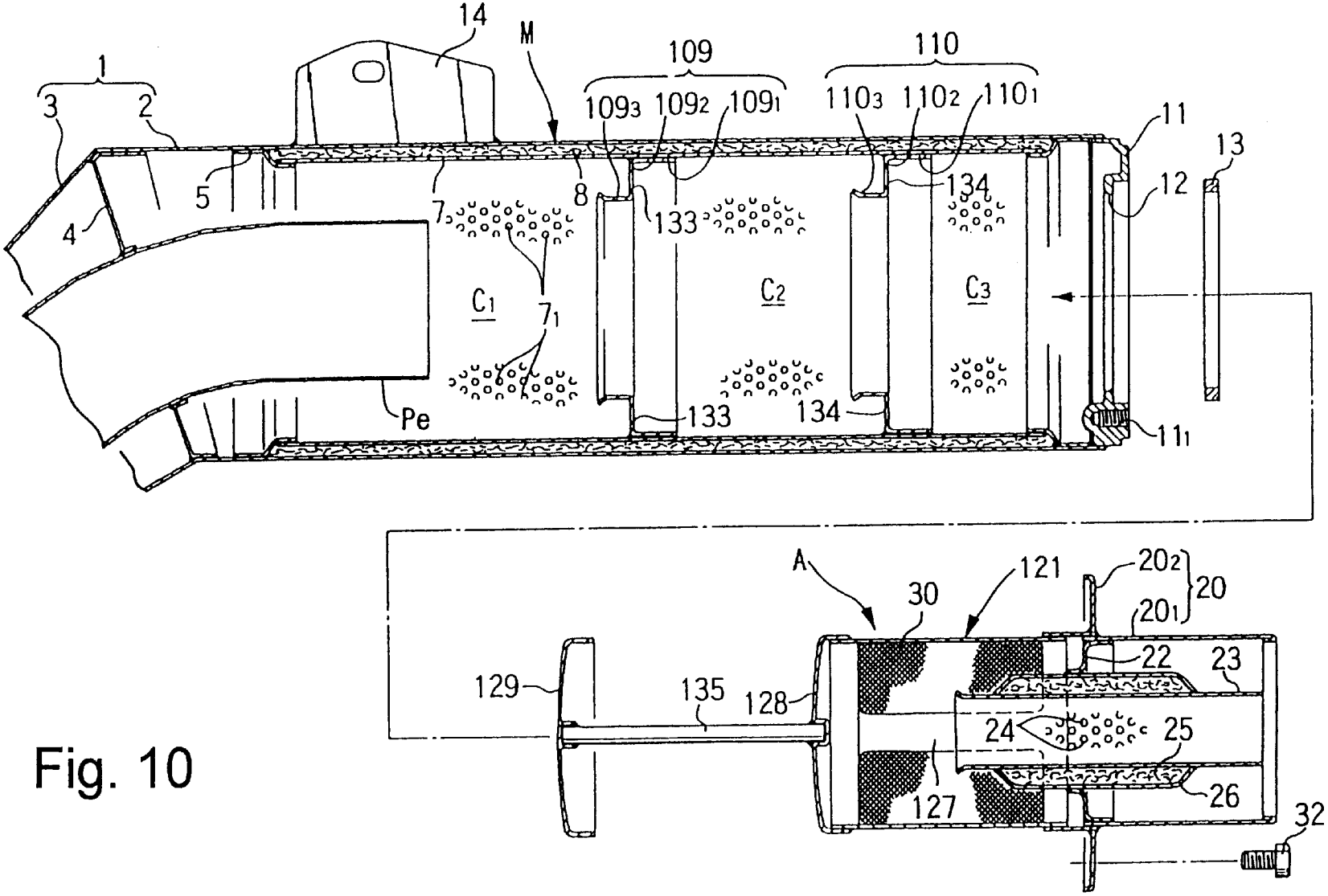
FIG. 10 is a longitudinal sectional view of the exhaust system in the second embodiment, in which the muffler and the spark arrester are separated.

A procedure for detachably attaching the spark arrester A to the muffler M will be described hereinafter. As shown in FIG. 7, the spark arrester A is inserted through the rear end of the muffler M so that a spark arrester body 121 extends coaxially with a rear half portion of the muffler M. The front portion of the holder 20 is closely fitted in the central opening 12 of the end plate 11 of the muffler M. The flange $\mathbf{20}_2$ is fastened to the end plate 11 with a plurality of bolts 32. Thus, the spark arrester A is detachably attached to the rear half portion of the muffler M. In this state, the spark arrester body 121 is held coaxially with the rear half portion of the muffler M, the end cap 129 is fitted closely in the reduced section $\mathbf{109}_3$ of the first separator 109, and the middle cap 128 is fitted closely in the reduced section $\mathbf{110}_3$ of the second separator 110. The first expansion chamber $C_1$ and the second expansion chamber $C_2$ communicate with each other by means of the first restricting passages 133, i.e., the circular slots of the first separator 109, and the second expansion chamber $C_2$ and the third expansion chamber $C_3$ communicate with each other by means of the second restricting passages 134, i.e., the circular slots of the second separator 110.

The third expansion chamber $C_3$ is divided into an unclean gas chamber $C_3$-D and a clean gas chamber $C_3$-C by a filter element 30. The front end of a tail pipe 23 opens into the clean gas chamber $C_3$-C.

The operation of the second embodiment will be described hereinafter. While the engine E is in operation, the exhaust gas discharged from the engine E flows through the exhaust pipe Pe into the muffler pipe 2 of the muffler M. In the muffler pipe 2, the exhaust gas is expanded and compressed repeatedly while the exhaust gas flows sequentially through the first expansion chamber $C_1$, the first restricting passage 133, the second expansion chamber $C_2$, the second restricting passage 134 and the third expansion chamber $C_3$, so that exhaust noise generated by the exhaust gas is attenuated effectively. While the exhaust gas is flowing from the unclean chamber $C_3$-D through the filter element 30 into the clean chamber $C_3$-C in the third expansion chamber $C_3$, unburned components including soot contained in the exhaust gas is arrested by the filter element 30. Thus, the exhaust gas is purified and the exhaust noise of the exhaust gas is attenuated. The exhaust gas is discharged through the tail pipe 23 into the atmosphere.

Although the preferred embodiments have been described, the present invention is not limited thereto in its practical application and may be practiced in various embodiments. For example, although the present invention has been described as applied to the exhaust system of a motorcycle, the present invention is applicable to exhaust systems for vehicles other than a motorcycle. Further, the muffler and the spark arrester need not necessarily be formed in the shapes of circular cylinders, but may be formed in the shapes of elliptic cylinders or cylinders of cross sections other than a circular cross section. The interior of the muffler tube may be divided into two, four or more than four expansion chambers instead of three expansion chambers.

As is apparent from the foregoing description, the interior of the muffler is divided into the plurality of expansion chambers sequentially connected by restricting passages by the separators and the spark arrester placed within the muffler. Therefore, the interior of the muffler can be very easily divided into the plurality of expansion chambers without requiring additional parts including connecting pipes, and the adjacent expansion chambers can be made to communicate with each other by means of the restricting passages, so that the exhaust noise generated by the exhaust gas flowing through the exhaust pipe into the muffler can be effectively attenuated, and the unburned components including soot of the exhaust gas can be arrested by the spark arrester.

According to the invention, the spark arrester is attached detachably to the muffler. Therefore, maintenance of the spark arrester is easy, and an exhaust system having desired characteristics can be provided at a low cost by combining an appropriate spark arrester with the muffler.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A muffler assembly comprising:

a muffler housing;

at least one separator located within said muffler housing for longitudinally dividing the muffler housing into a first compartment and a second compartment;

a spark arrester having a tail pipe therein, said spark arrester being located at least partially within said muffler housing and having a cap engagable with said at least one separator; and an annular exhaust gas passage formed between an outer periphery of said cap and an inner periphery of said at least one separator.

2. The muffler assembly according to claim 1, wherein said at least one separator has an outer wall member, an inner wall member, and an intermediate wall member extending between said outer wall member and said inner wall member.

3. The muffler assembly according to claim 2, wherein said intermediate wall member is radially directed, and includes at least one aperture therein for allowing exhaust gasses to pass therethrough.

4. The muffler assembly according to claim 1, wherein said tail pipe includes an inner pipe having a plurality of perforations therein, and an outer pipe surrounding a portion of said inner pipe and enclosing said perforations.

5. The muffler assembly according to claim 1, wherein said spark arrester has a flange extending therearound which is engagable with an end plate located at one end of said muffler housing.

6. The muffler assembly according to claim 1, wherein said spark arrester includes a cylindrical filter member through which said exhaust gasses pass prior to exiting said muffler housing through said tail pipe.

7. A muffler assembly comprising:

a muffler housing;

a first separator and a second separator located within said muffler housing for longitudinally dividing the muffler housing into a first compartment, a second compartment, and a third compartment; and a spark arrester having a tail pipe therein, said spark arrester being located at least partially within said muffler housing, said spark arrester having first and second caps engagable with said first separator and said second separator, respectively.

8. The muffler assembly according to claim 7, wherein each of said separators has an outer wall member, an inner wall member, and an intermediate wall member extending between said outer wall member and said inner wall member.

9. The muffler assembly according to claim 8, wherein each said intermediate wall member is radially directed, and includes at least one aperture therein for allowing exhaust gasses to pass therethrough.

10. The muffler assembly according to claim 7, further comprising a longitudinally extending rod interconnecting said first cap and said second cap.

11. The muffler assembly according to claim 7, further comprising a plurality of longitudinally extending ribs interconnecting said first cap and said second cap.

12. The muffler assembly according to claim 7, further comprising first and second annular exhaust gas passages formed between and outer periphery of said first and second caps and an inner periphery of said first and second separators.

13. The muffler assembly according to claim 7, wherein said tail pipe includes an inner pipe having a plurality of perforations therein, and an outer pipe surrounding a portion of said inner pipe and enclosing said perforations.

14. The muffler assembly according to claim 7, wherein said spark arrester has a flange extending therearound which is engagable with an end plate located at one end of said muffler housing.

15. The muffler assembly according to claim 7, wherein said spark arrester includes a cylindrical filter member through which said exhaust gasses pass prior to exiting said muffler housing through said tail pipe.

* * * * *